US007698761B2

(12) United States Patent
Neuenswander et al.

(10) Patent No.: US 7,698,761 B2
(45) Date of Patent: Apr. 20, 2010

(54) ADJUSTABLE BED HAVING FOUR LINEAR ACTUATORS

(75) Inventors: Jacob J. Neuenswander, Carthage, MO (US); William R. Rohr, Joplin, MO (US)

(73) Assignee: L&P Property Management Company, South Gate, CA (US)

( * ) Notice: Subject to any disclaimer, the term of this patent is extended or adjusted under 35 U.S.C. 154(b) by 307 days.

(21) Appl. No.: 12/025,205

(22) Filed: Feb. 4, 2008

(65) Prior Publication Data

US 2009/0193587 A1 Aug. 6, 2009

(51) Int. Cl.
*A47C 20/08* (2006.01)

(52) U.S. Cl. ..... 5/618; 5/611; 5/613

(58) Field of Classification Search ..... 5/600, 5/611, 613, 618

See application file for complete search history.

(56) References Cited

U.S. PATENT DOCUMENTS 4,785,487 A 11/1988 Toran
5,640,730 A 6/1997 Godette
6,006,379 A 12/1999 Hensley
6,499,162 B1 12/2002 Lu
6,640,365 B1 11/2003 Chang
6,739,004 B1 5/2004 Abrahamsen et al.
6,961,971 B2 11/2005 Schneider et al.
7,036,166 B2 5/2006 Kramer et al.
2002/0189015 A1 12/2002 Barssessat
2004/0103476 A1 6/2004 Barcesat
2008/0262657 A1* 10/2008 Howell et al. ..... 700/275

* cited by examiner

*Primary Examiner*—Fredrick Conley
(74) *Attorney, Agent, or Firm*—Wood, Herron & Evans, LLP

(57) ABSTRACT

An adjustable bed includes a stationary seat deck board and independently movable front and rear carriages powered by linear actuators supported by a stationary base. A head deck board is hingedly secured to the front carriage and moves with it. Leg and foot deck boards hingedly joined together are supported by the rear carriage and move with it. Additional linear actuators move the head deck board and leg deck boards between horizontal and inclined positions independently.

20 Claims, 8 Drawing Sheets

ADJUSTABLE BED HAVING FOUR LINEAR ACTUATORS

FIELD OF THE INVENTION

This invention relates generally to adjustable beds and, more particularly, to an adjustable bed having four motorized linear actuators.

BACKGROUND OF THE INVENTION

A well known type of bedding product comprises a motorized adjustable bed in which an articulated frame supports a mattress. These motorized adjustable beds have traditionally been used in hospitals but more and more are being installed and used in residential homes. Motorized adjustable beds have conventionally had an upper body support movable between an inclined position in which it supports the patient in a sitting position and a prone position in which the patient lies down in a generally horizontal position. In addition, a leg support is movable between positions and may be adjusted to a desired degree of inclination. An actuating mechanism, commonly two electric motors, raises and lowers the head and leg supports of the articulated bed frame. U.S. Pat. No. 5,640,730 discloses such an adjustable bed.

U.S. Pat. Nos. 6,499,162 and 6,640,365 disclose adjustable beds comprising a plurality of bed plates pivotally secured together for supporting a mattress. Connecting elements or links pivotally connect a base to the bed plates. A movable member slides along the base and is activated by a piston movable from inside a cylinder secured to the base. Activation of a power source such as an electric motor causes movement of the bed plates via movement of the sliding member.

One of the drawbacks of known adjustable beds may be discomfort to the user while adjusting the bed to a particular position.

It has therefore been an objective of this invention to provide an adjustable bed with more than two linear actuators to increase the comfort of the user. To that end, and in accordance with this invention, two motorized linear actuators may be activated to independently move adjustable bed plates between a fully inclined position and a horizontal portion while simultaneously additional motorized linear actuators may be activated to move portions of the adjustable bed horizontally.

SUMMARY OF THE INVENTION

This invention comprises an adjustable bed having an adjustable deck for supporting a mattress. The adjustable bed is powered by four electric motor driven linear actuators. However, any other drive assemblies, such as a conventional electrical motor driven screw and nut linear actuators may be used in accordance with the present invention.

The adjustable bed, in one embodiment, comprises a generally rectangular stationary base comprising a pair of opposed side rails, a head end rail and a toot end rail located at the head and foot ends of the adjustable bed, respectively. Supports or legs extending downwardly from the head and foot end rails support the base a fixed distance above the floor or supporting surface. Although supports of a fixed length are preferable, other types of supports may be used to raise and/or lower the stationary base relative to the supporting surface.

Each of the side rails of the base has a channel built therein. More particularly, each of the side rails of the stationary base has a "C-shaped" cross-sectional configuration which defines the channel.

This adjustable bed further comprises a pair of mounting members secured to the stationary base which are stationary. A stationary seat deck board is secured to the stationary mounting members and extends between the mounting members. Each of the mounting members comprises a generally "L-shaped" member comprising a vertically oriented leg portion and a horizontally oriented side portion. A support leg is secured to the horizontally oriented side portion of the generally "L-shaped" member so each mounting member has two legs which are welded or otherwise secured to the side rails of the stationary base.

The adjustable bed further comprises front and rear carriages movable relative to the stationary base between "in" and "out" positions. Each of the carriages has four legs, two on each side of the carriage. Each of legs has a roller rotatably secured to the leg at the bottom thereof. The rollers travel or move in the channels of the side rails of the stationary base to move each carriage horizontally.

The adjustable bed further comprises a deck for supporting a mattress or similar product. The deck comprises a head deck board hingedly secured to the movable front carriage and movable with the front carriage, a stationary seat deck board fixedly secured to the mounting members, a leg deck board hingedly secured to the movable rear carriage and movable with the rear carriage and a foot deck board hingedly joined to the leg deck board and movable with the rear carriage. The front deck board may be considered a front deck section and the combined leg and foot deck boards may be considered a rear deck section for purposes of this document. Each deck section is movable between a horizontal position in which the deck board or boards are horizontal and coplanar and a fully inclined position in which the deck board or boards are inclined. Cushions are secured to each deck board in one embodiment. However, any type of cushioning device may be supported by a deck board; for example, an upholstered spring core or an air bladder.

Each deck section may assume either a horizontal position or a fully inclined position regardless of whether the carriage supporting the deck section is in an "in" position (in which the front carriage and attached head deck board are adjacent the seat deck board and similarly the rear carriage and associated leg and foot deck boards are adjacent the seat deck board) or an "out" position (in which the front carriage and attached head deck board are spaced from the seat deck board and similarly the rear carriage and associated leg and foot deck boards are spaced from the seat deck board). Each carriage may be moved independently of the other carriage and each deck section may be moved or adjusted regardless of the position of the carriage. For example, if the front carriage is in its "in" position and the rear carriage is in its "out" position, the front deck board may be inclined and the leg and foot deck boards horizontal. Alternatively, with the front carriage is in its "in" position and the rear carriage is in its "out" position, the front deck board may be horizontal and the leg and foot deck boards fully inclined. Thus, there are four different extreme positions and multiple intermediate positions.

The adjustable bed further comprises a pair of foot links which connect the movable rear carriage to the foot deck board. Each foot link has an adjustable length but may be manually set to have a predetermined, fixed length. Each foot link is pivotally secured to one of the legs of the rear carriage at one end and pivotally secured to a bracket fixedly secured to the foot deck board at its other end.

A first motorized linear actuator is operatively coupled or secured to a support extending between the side rails of the stationary base. This first linear actuator functions to move the front carriage between a first "in" position and a second "out" position.

A second motorized linear actuator is operatively coupled or secured to the support of the stationary base. This second linear actuator functions to move the rear carriage between a first "in" position and a second "out" position independent of the movement or position of the first linear actuator.

A third motorized linear actuator is operatively coupled or secured to the front carriage and moves with the front carriage. This third linear actuator functions to move the head deck board between a first horizontal position and a second fully inclined position.

A fourth motorized linear actuator is operatively coupled or secured to the rear carriage and moves with the rear carriage. This fourth linear actuator functions to move the leg deck board between a first horizontal position and a second fully inclined position. The foot deck board hingedly secured to the leg deck board inclines when the leg deck board inclines and is horizontal when the leg deck board is horizontal.

In one common operation, starting from the first extreme position of the adjustable bed in which the deck is generally horizontal and the carriages are in their "in" position, an operator activates the first and second motorized linear actuators in any known manner. The motorized linear actuators move the front and rear carriages from their "in" position to their "out" position. The adjustable bed is now in a second extreme position. The operator may then simultaneously activate the third and fourth motorized linear actuators in any known manner to raise the head, leg and foot deck boards from their horizontal positions to their fully inclined positions simultaneously to put the adjustable bed in a fourth extreme position. Inclination of the leg deck board causes the foot deck board to incline, its foot edge moving towards the head end of the bed as the foot links pivot about horizontal pivot axes. Alternatively, an operator may activate only the third motorized linear actuator to raise the head deck board from a horizontal position to a fully inclined position to put the adjustable bed in a third extreme position. Alternatively, an operator may activate only the fourth motorized linear actuator to raise the leg and foot deck boards from a horizontal position to a fully inclined position to put the adjustable bed in another extreme position.

This embodiment of the adjustable bed allows a user to move two carriages relative to a stationary base using rollers traveling in channels in the base. Each carriage supports one or more deck boards or sections of the adjustable bed. The adjustable bed enables the deck boards or sections to move between a first horizontal or prone position to a second inclined position with the assistance of motorized linear actuators regardless of the position of the front and rear carriages.

These and other objects and advantages of the present invention will be more readily apparent from the following drawings.

DETAILED DESCRIPTION OF THE DRAWINGS

Figure 1:
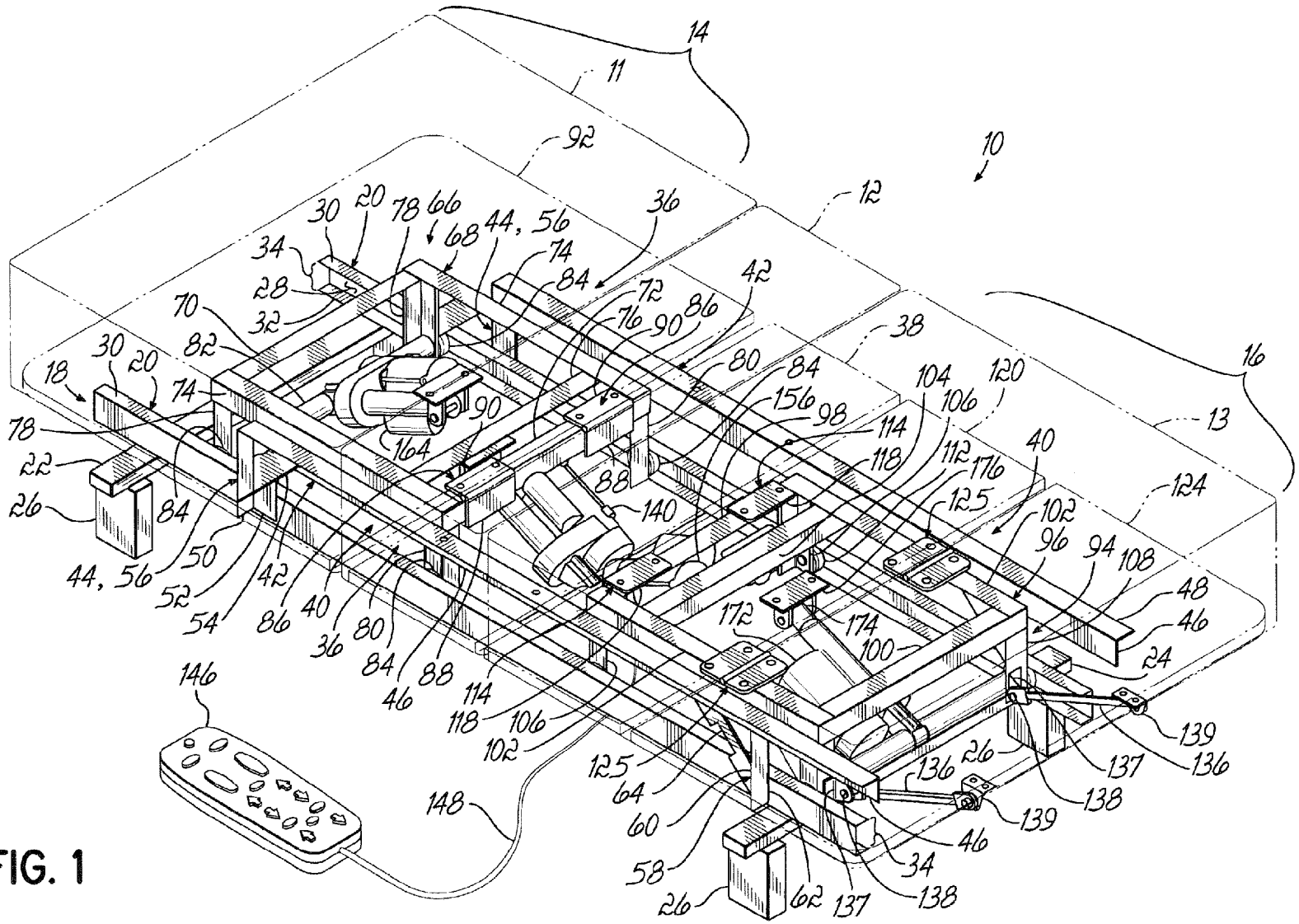
FIG. 1 is a perspective view of an adjustable bed made in accordance with this invention showing the deck boards in phantom in a horizontal position and the front and rear carriages in their "in" positions supporting cushions shown in phantom.

Referring to the drawings, and particularly to FIG. 1, there is illustrated an adjustable bed 10 including cushions 11, 12 and 13 shown in phantom. The adjustable bed 10 may be used to support any type of cushions.

Figure 2:
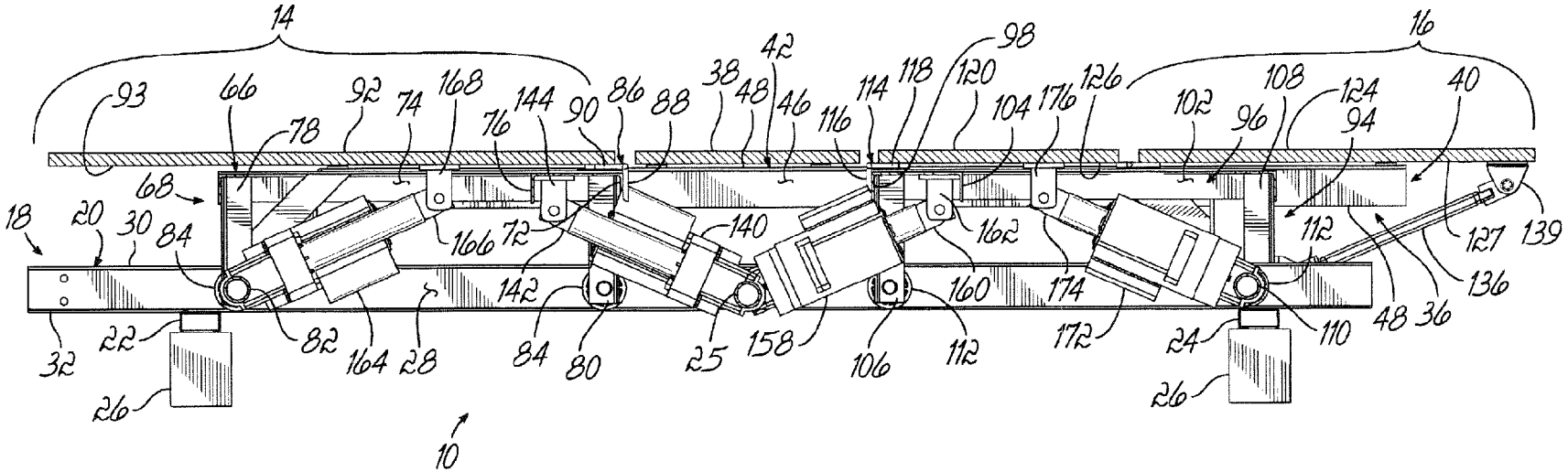
FIG. 2 is a longitudinal cross-sectional view of the adjustable bed of FIG. 1 without the cushions showing the deck boards in a horizontal position and the front and rear carriages in their "in" positions.
Figure 3:
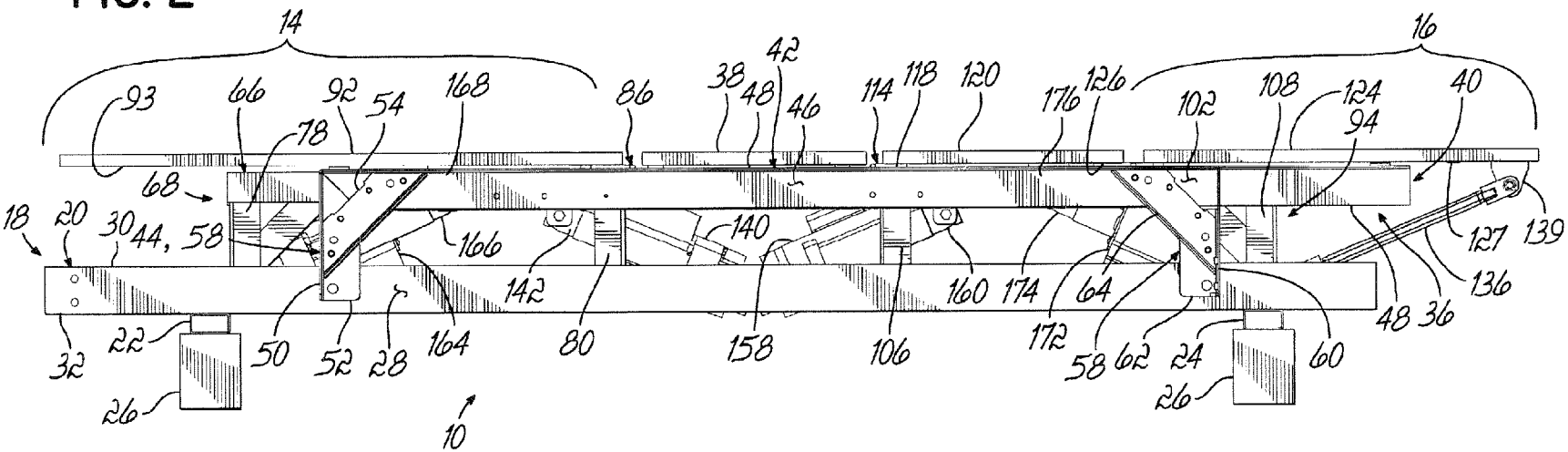
FIG. 3 is a side elevational view of the adjustable bed of FIG. 1 without the cushions showing the deck boards in a horizontal position and the front and rear carriages in their "in" positions.
Figure 4:
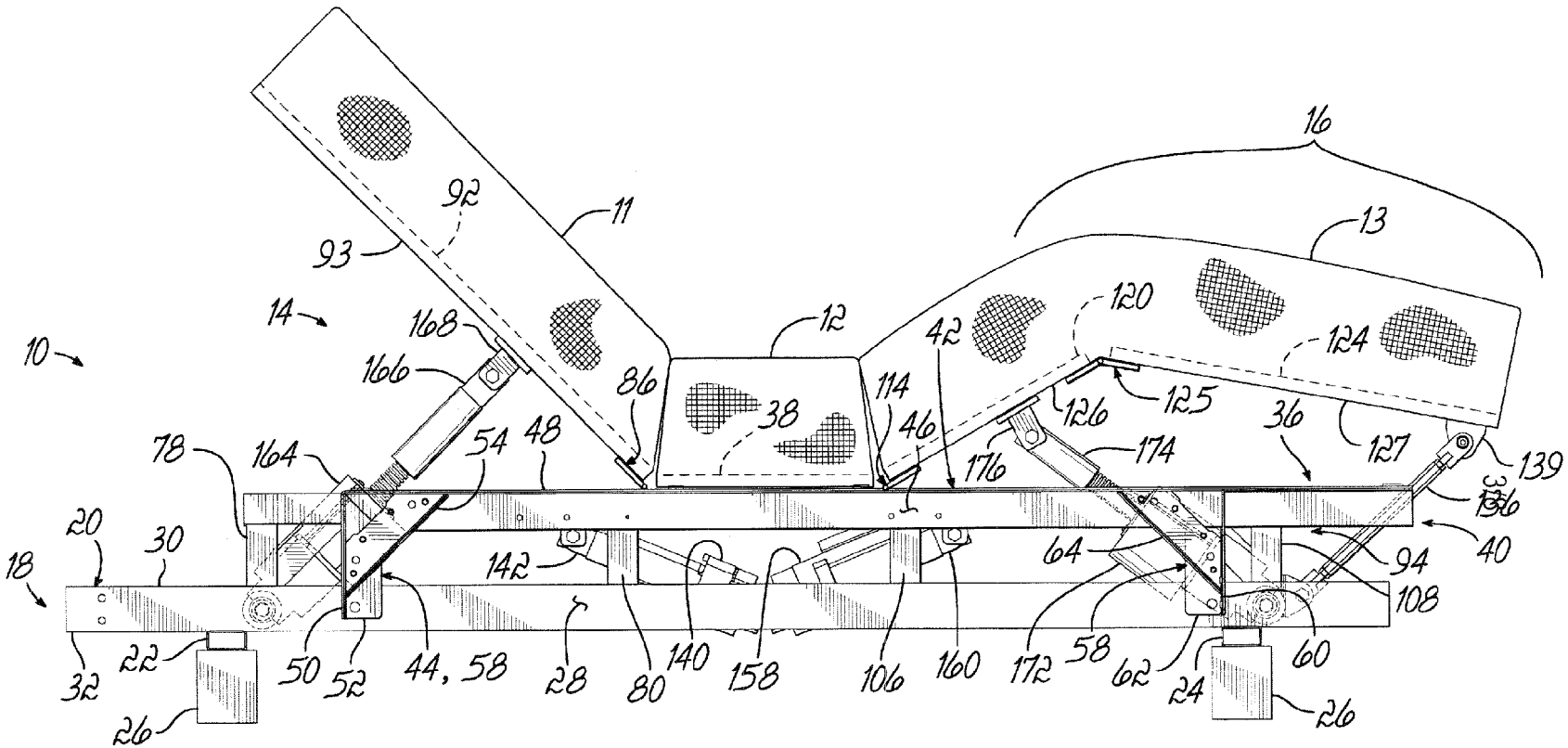
FIG. 4 is a side elevational view of the adjustable bed of FIG. 1 with the cushions showing the deck boards and cushions in a fully inclined position and the front and rear carriages in their "in" positions.
Figure 5:
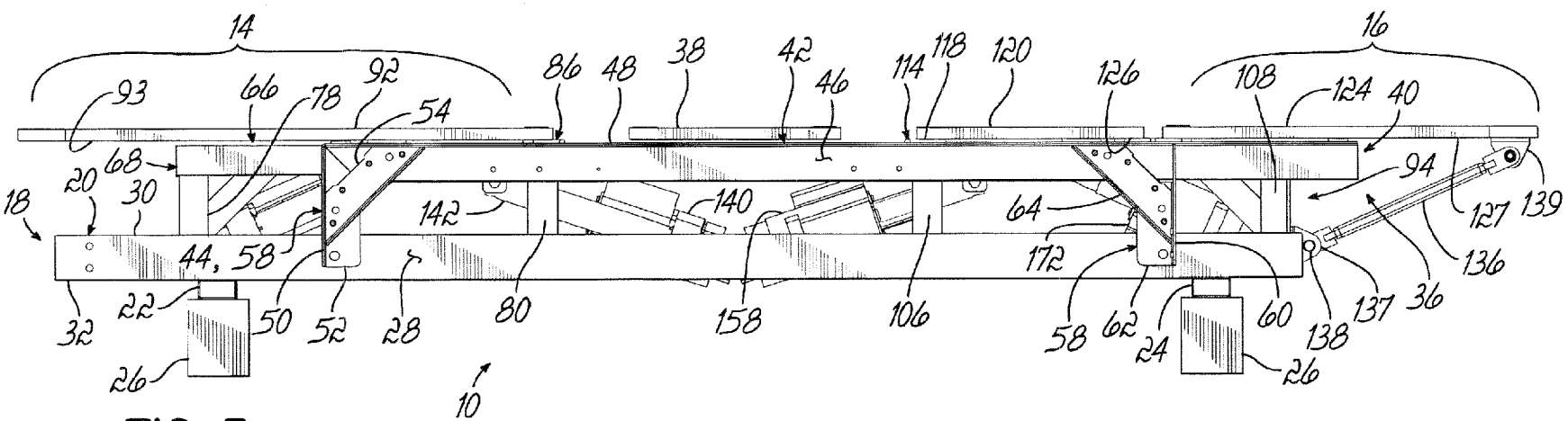
FIG. 5 is a side elevational view of the adjustable bed of FIG. 1 without the cushions showing the deck boards in a horizontal position and the front and rear carriages in their "out" positions.
Figure 6:
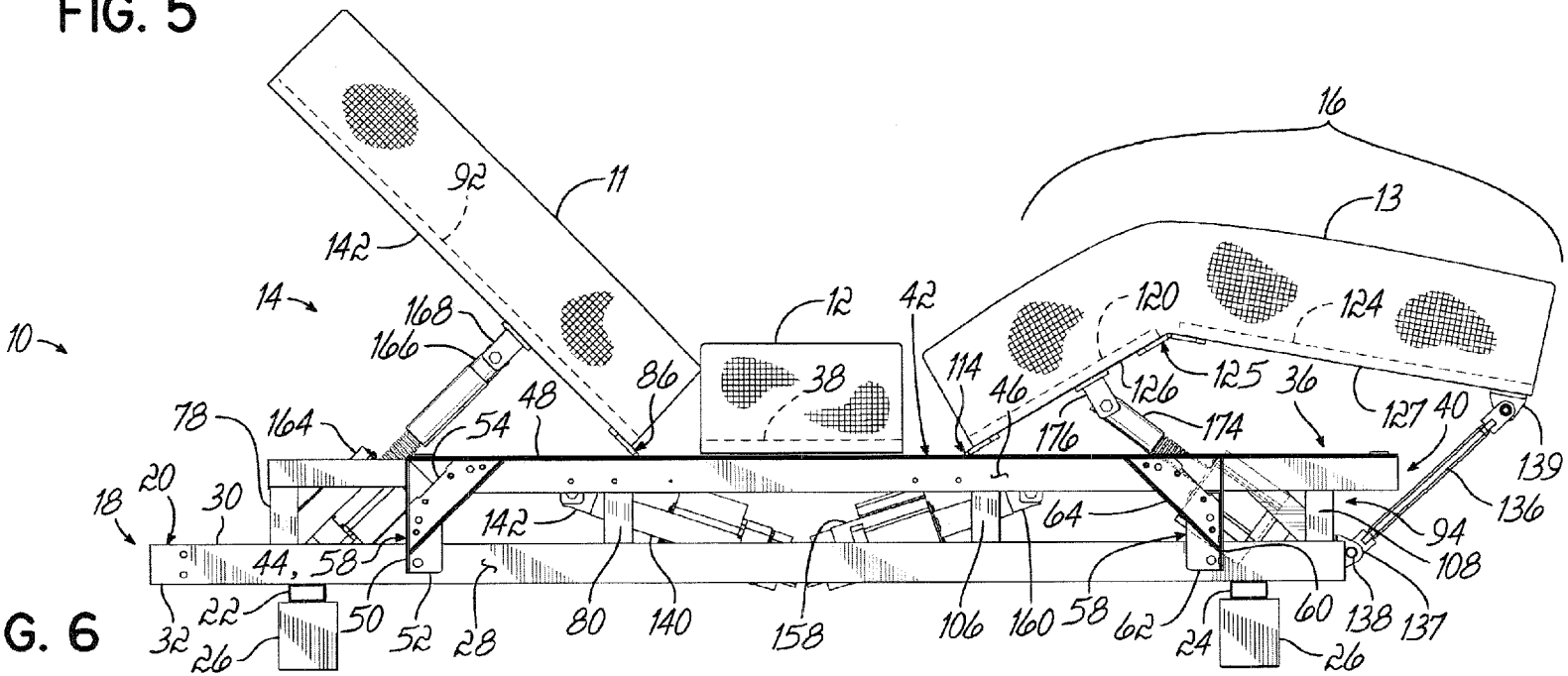
FIG. 6 is a side elevational view of the adjustable bed of FIG. 1 with the cushions showing the deck boards in a fully inclined position and the front and rear carriages in their "out" positions.

The adjustable bed 10 has a head end 14 and a foot end 16. The adjustable bed 10 is movable between multiple positions. Although four extreme positions are shown, the adjustable bed 10 may assume any number of intermediate positions FIGS. 1, 2 and 3 show the adjustable bed 10 in its first extreme position in which the deck boards are in their horizontal position and the front and rear carriages are in their "in" positions. FIG. 4 shows the adjustable bed 10 in a second extreme position in which the deck boards are in their fully inclined position and the front and rear carriages are in their "in" positions. FIG. 5 shows the adjustable bed 10 in its third extreme position in which the deck boards are in their horizontal position and the front and rear carriages are in their "out" positions. FIG. 6 shows the adjustable bed 10 in its fourth extreme position in which the deck boards are in their fully inclined position and the front and rear carriages are in their "out" positions. Typically, an operator or user sleeps with the adjustable bed in its first extreme horizontal position and reads or watches television with the adjustable bed in its fourth extreme position. However, the adjustable bed 10 may assume any intermediate position between the extreme positions illustrated and maintained in such a position.

The adjustable bed 10 comprises a stationary generally rectangular base 18 comprising a pair of opposed side rails 20, a head end rail 22 and foot end rail 24 under opposed side rails 20, a linear actuator support 25 extending between the opposed side rails 20 (see FIGS. 2 and 8) and four legs 26 supporting the base 18 a fixed distance about a floor or supporting surface (not shown). The head and foot end rails 22, 24, respectively, along with the linear actuator support 25 each are secured to each side rail 20 and extend therebetween.

The head and foot end rails 22, 24, respectively, along with legs 26 are illustrated being rectangular in cross-section. However, they may be any desired size or shape, hollow or solid. The linear actuator support 25 is illustrated being circular in cross-section. However, it may be any desired size or shape, hollow or solid. The legs 26 are shown secured and extending downwardly from the head and foot end rails 22, 24, respectively, but may be secured to the side rails 20 if desired. Although a one type of leg 26 is illustrated, any configuration or length of leg or similar support for the base 20 may be used.

As shown in the drawings, each of the side rails 20 of the base 18 has a generally C-shaped cross-sectional configuration including a vertically oriented side portion 28, a horizontally oriented top portion 30 extending outwardly from the upper edge of the side portion 28 and a horizontally oriented bottom portion 32 extending outwardly from the lower edge of the side portion 28. The side, top and bottom portions, 28, and 32, respectively, define an inwardly facing channel 34 in each side rail 20 of the base 18. Although each side rail 20 is illustrated having a generally C-shaped cross-sectional configuration along its entire length, any desired configuration or length of side rail may be used in the base 18. For example, the channels may be shaped differently than those illustrated.

The adjustable bed 10 further comprises a pair of mounting members 36 welded, secured or fixed to the side rails 20 of the stationary base 18. Each of the mounting members 36 comprises a generally "L-shaped" member 40 having a horizontal portion 42 and a front leg portion 44 at the head end 14 of the adjustable bed 10 extending downwardly from the horizontal portion 42 of the generally "L-shaped" member 40. The horizontal portion 42 has a vertical flange 46 and a horizontal flange 48 while the front leg portion 44 has a first flange 50, a continuation of the horizontal flange 48 and a second flange 52, a continuation of the vertical flange 46, best shown in FIG. 8. Thus, each portion 42, 44 of each generally "L-shaped" member 40 has an "L-shaped" cross sectional configuration.

A front brace 54 extends between the horizontal portion 42 and the front leg portion 44 of the generally "L-shaped" member 40. The brace 54 is riveted, welded or otherwise secured to the vertical flange 46 of the horizontal portion 42 and the second flange 52 of the front leg portion 44 of the generally "L-shaped" member 40. Although one configuration of front brace 54 is illustrated, other configurations or styles of braces may be used.

For purposes of this document, the front leg portion 44 of each generally "L-shaped" member 40 of each mounting member 36 may be referred to as a front leg 56 which is welded or otherwise fixedly secured at the bottom thereof to one of the side rails 20 of the base 18. Each of the mounting members 36 further comprises a support or rear leg 58 having a first flange 60 and a second flange 62 at right angles or orthogonal to each other. Thus, the support or rear leg 58 has a cross sectional configuration which is generally "L-shaped." The first flange 60 of the rear leg 58 is parallel the first flange 50 of the front leg 56 while the second flange 62 of the rear leg 58 is parallel the second flange 52 of the front leg 56.

A rear brace 64 extends between the horizontal portion 42 of the generally "L-shaped" member 40 and the rear leg 58. The rear brace 64 is riveted, welded or otherwise secured to the vertical flange 46 of the horizontal portion 42 of the generally "L-shaped" member 40 and the second flange 62 of the rear leg 58 of each mounting member 36. Although one configuration of rear brace 64 is illustrated, other braces may be used.

Figure 8:
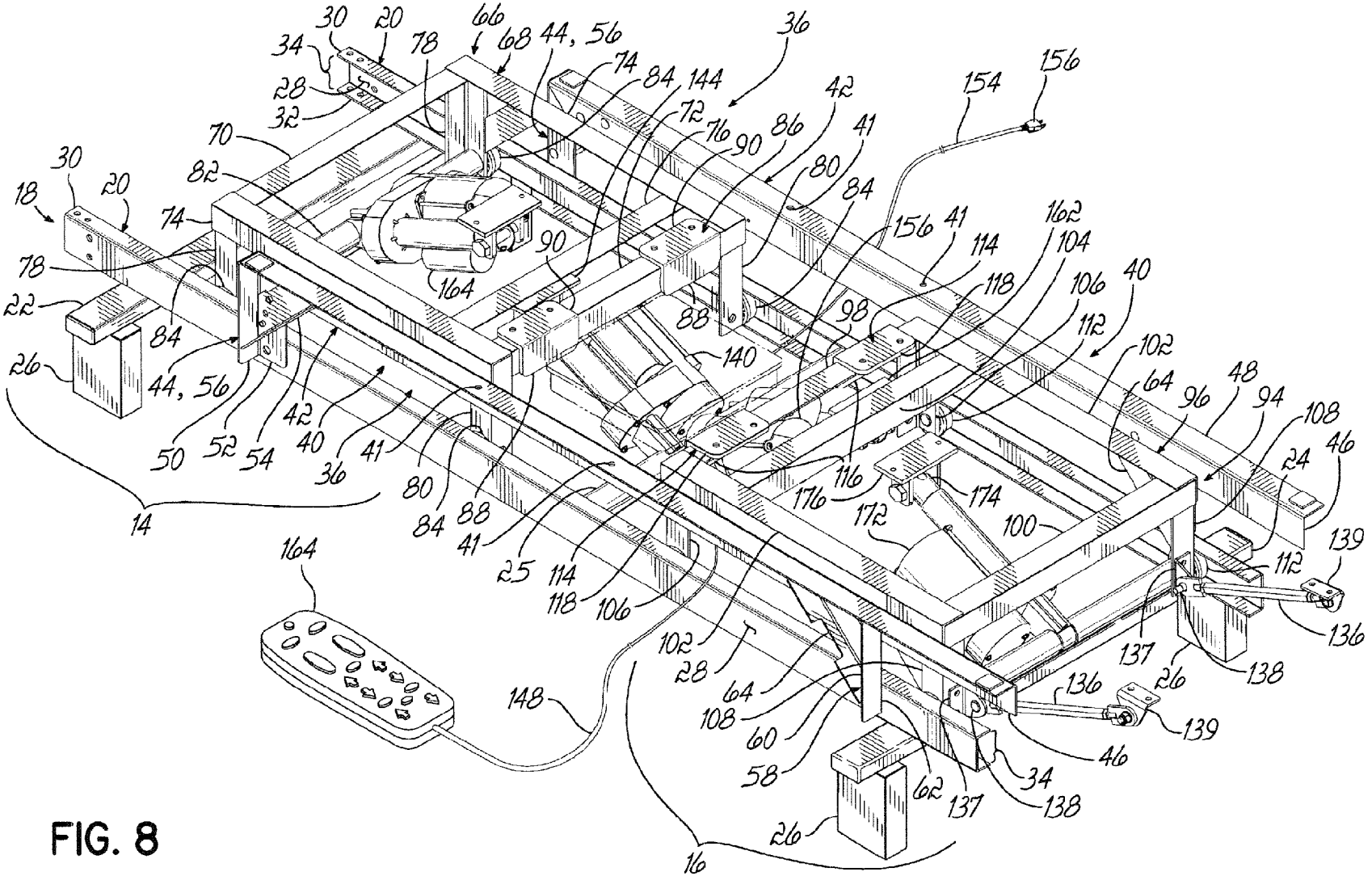
FIG. 8 is a perspective view of the adjustable bed of FIG. 1 without the cushions or deck boards, the front and rear carriages being in their "in" positions.
Figure 9:
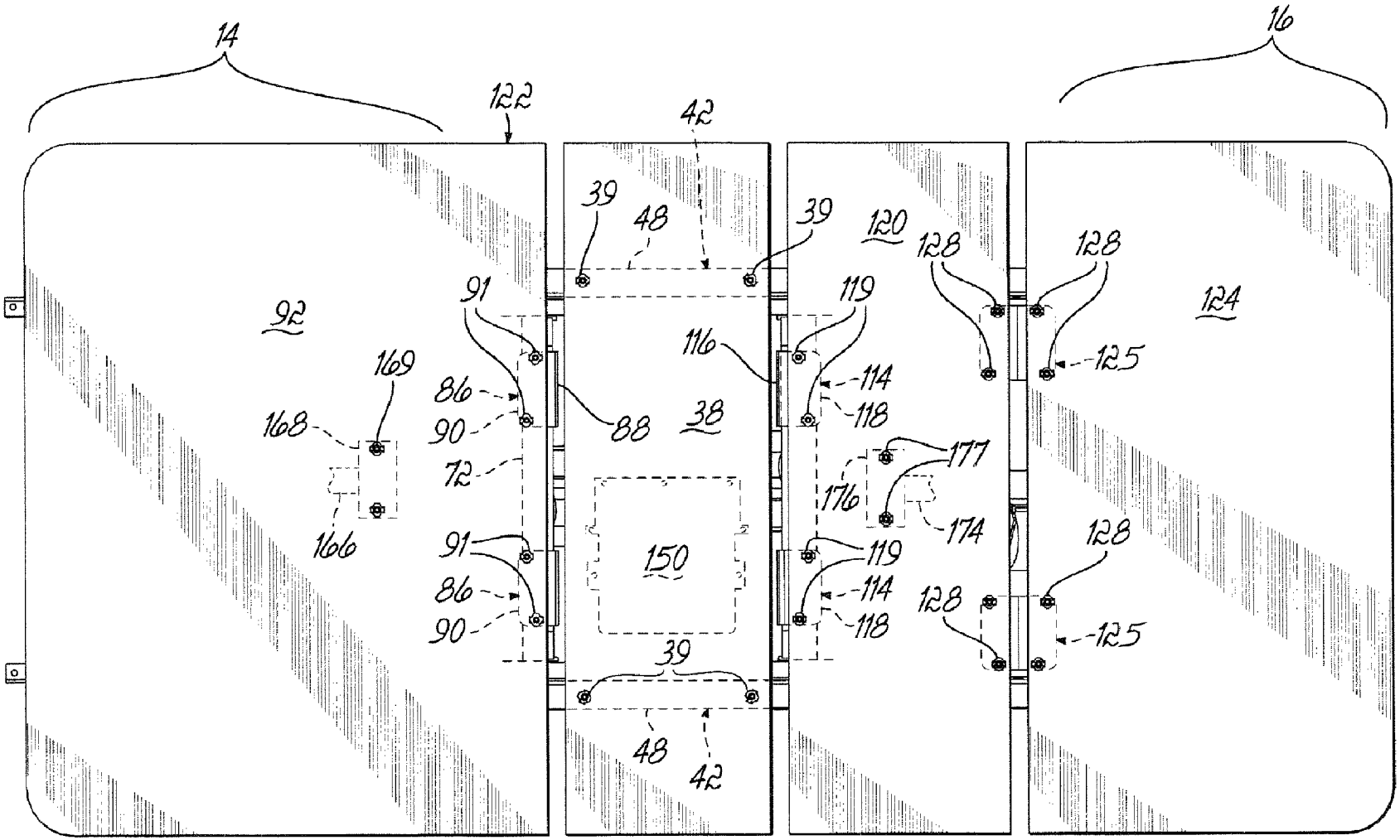
FIG. 9 is a top plan view of the adjustable bed of FIG. 1 without the cushions showing the deck boards in a horizontal position and the front and rear carriages in their "in" positions.

Although each stationary mounting member 36 is illustrated having a certain configuration and size, any desired configuration or size may be used in the adjustable bed 10. As shown in FIG. 9, a seat deck board 38 is secured to the mounting members 36 and more particularly, to the horizontal flanges 48 of the horizontal portions 42, with fasteners 39. See FIG. 9. As shown in FIG. 8, the fasteners 39 pass through holes 41 in the horizontal flanges 48 of the horizontal portions 42 of mounting members 36 to secure the seat deck board 38 to the stationary mounting members 36.

Referring to FIG. 1, the adjustable bed 10 further comprises a movable front carriage 66 comprising a generally rectangular platform 68 including a front member 70, rear member 72 and side members 74. An intermediate member 76 is secured to the side members 74 and extends therebetween parallel the front and rear members 70, 72. Although each of these members 70, 72, 74 and 76 are illustrated as having an "L-shaped" cross-sectional configuration, they may be any desired shape or configuration. The front carriage 66 further comprises two front legs 78, two rear legs 80 and a support 82 extending between the front legs 78. A roller 84 is rotatably secured to each leg 78, 80 at the bottom thereof and is sized and adapted to travel inside the channel 34 of one of the side rails 20 of the stationary base 18 as the front carriage 66 moves horizontally between its "in" and "out" positions.

The movable front carriage 66 has a pair of hinges 86 welded or otherwise secured to the rear member 72 of the generally rectangular platform 68 of the front carriage 66. Each hinge 86 has a vertical portion 88 welded or otherwise secured to the rear member 72 of the generally rectangular platform 68 of the front carriage 66 and a horizontal portion 90 secured with fasteners 91 to the head deck board 92. See FIGS. 2, 8 and 9. Although the hinges 86 are preferably made of metal, they may be made of any desired material. Being secured to the hinges 86, the head deck board 92 travels with the movable front carriage 66 and is supported by the generally rectangular platform 68 of the front carriage 66 when in the horizontal position.

The adjustable bed 10 further comprises a rear carriage 94 comprising a generally rectangular platform 96 including a front member 98, rear member 100 and side members 102. An intermediate member 104 is secured to the side members 102 and extends therebetween parallel the front and rear members 98, 100. Although each of these members 98, 100, 102 and 104 are illustrated as having an "L-shaped" cross-sectional configuration, they may be any desired shape or configuration. The rear carriage 94 further comprises two front legs 106, two rear legs 108 and a support 110 extending between the rear legs 108. A roller 112 is rotatably secured to each leg 106, 108 at the bottom thereof and is sized and adapted to travel inside the channel 34 of one of the side rails 20 of the stationary base 18 as the rear carriage 94 moves horizontally between its "in" and "out" positions.

The movable rear carriage 94 has a pair of hinges 114 welded or otherwise secured to the front member 98 of the generally rectangular platform 96 of the rear carriage 94. Each hinge 114 has a vertical portion 116 welded or otherwise secured to the front member 98 of the generally rectangular platform 96 of the rear carriage 94 and a horizontal portion 118 secured with fasteners 119 to the leg deck board 120. See FIGS. 2, 8 and 9. Although the hinges 114 are preferably made of metal, they may be made of any desired material. Due to the hinges 114, the foot deck board 120 travels with the movable rear carriage 94 and is supported by the generally rectangular platform 96 of the rear carriage 94 when in the horizontal position.

As shown in FIG. 9, the adjustable bed 10 has a deck 122 comprising head deck board 92 secured to the movable front carriage 66, a stationary seat deck board 38 fixedly secured to the mounting members 36, a leg deck board 120 secured to the movable rear carriage 94 and a foot deck board 124 hingedly secured to the leg deck board 120. Each of the deck boards is preferably the same width but any two deck boards may be different widths, if desired. Any of the deck boards may have a generally rectangular cutout adapted to receive and retain a massage unit, as known in the art.

As best illustrated in FIGS. 1 and 9, the foot deck board 124 is hingedly secured to the leg deck board 120 with hinges 125 secured to the lower surfaces 126, 127 of the leg and foot deck boards 120, 124, respectively, with fasteners 128. See also FIGS. 1 and 4. Similarly, head deck board 92 is hingedly secured to the movable front carriage 66 with hinges 86 secured to the lower surface 93 of the head deck board 92 with fasteners 91. Leg deck board 120 is hingedly secured to the movable rear carriage 94 with hinges 114 secured to the lower surface 126 of the leg deck board 120 with fasteners 119. In each of these instances, although, two hinges are shown securing adjacent deck boards or a deck board to a carriage, any number of hinges may be used including one continuous hinge.

The deck boards 92, 38, 120 and 124 are preferably made of plywood, but may be made of plastic, oriented strand board or any other material. As illustrated in FIGS. 1, 4 and 6, a first cushion 11 is secured to the head deck board 92, a second cushion 12 is secured to the stationary seat deck board 38 and a third cushion 13 is secured to the leg and foot deck boards 120, 124.

The adjustable bed 10 further comprises two foot links 136 or connectors, each being adjusted to the same fixed length. Each of the foot links 136 is pivotally secured at a lower end to a bracket 137 secured to one of the rear legs 108 of the rear carriage 94 with fastener 138 so that each pivots about a horizontal pivot axis. See FIG. 1. Each foot link 136 is pivotally secured at its upper end to a bracket 139 fixed to the lower surface 127 of the foot deck board 124.

Figure 7:
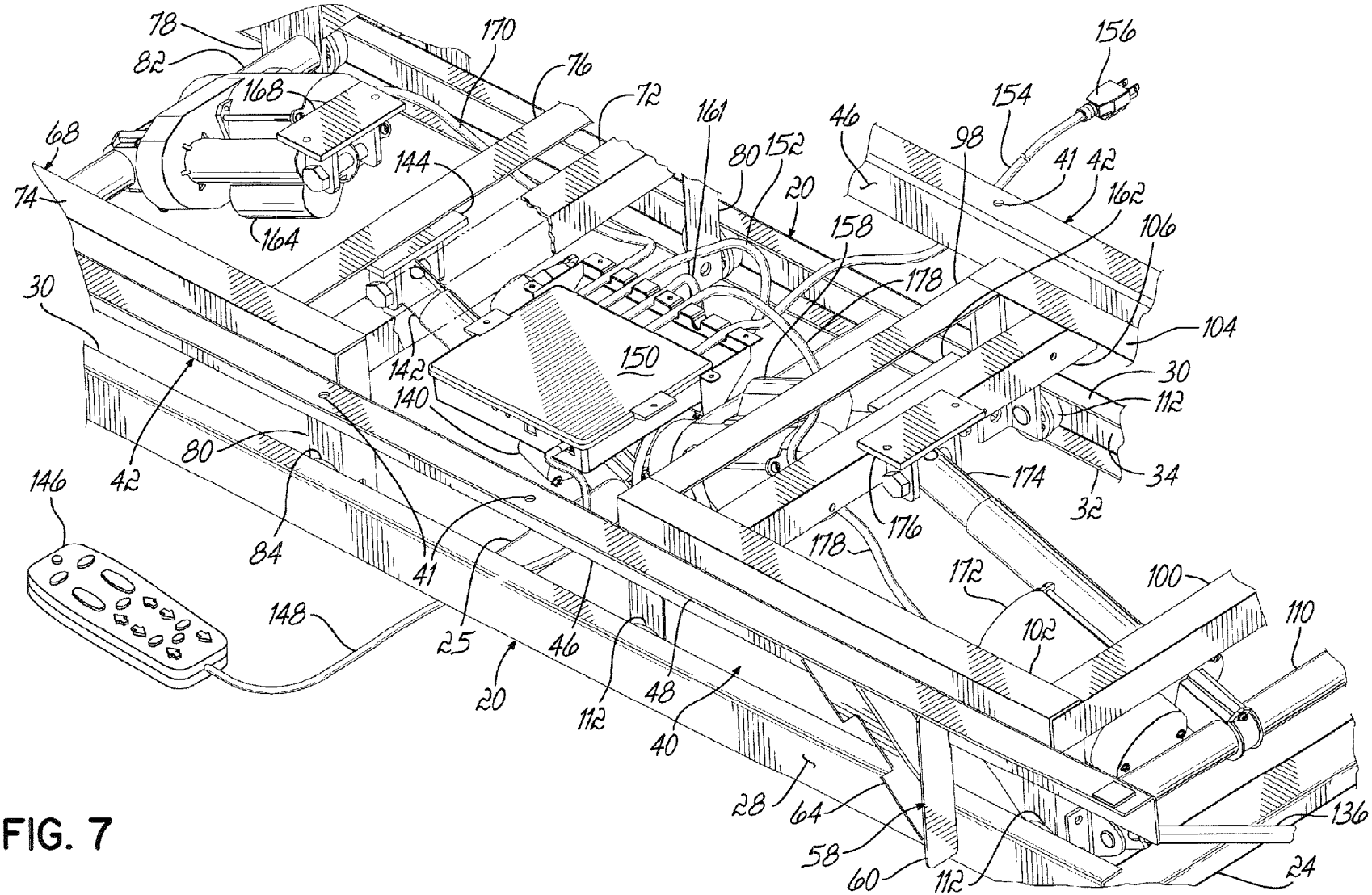
FIG. 7 is an enlarged perspective view of a portion of the adjustable bed of FIG. 1 without the cushions and deck boards, the front and rear carriages being in their "in" positions, showing the control box.

As best illustrated in FIG. 2, a first motorized linear actuator 140 is secured at one end to the linear actuator support 25 of base 18. This first linear actuator 140 is used to move the front carriage 66 between an "in" position shown in FIGS. 1-4, 7, 8 and 9 and an "out" position shown in FIGS. 5 and 6, the rollers 84 of the front carriage 66 rotating or sliding in the channels 34 of the side rails 20 of stationary base 18. As best illustrated in FIG. 7, the first linear actuator 140 has a driver 142 which is pivotally secured to a bracket 144 secured to the intermediate member 76 of the movable front carriage 66. The driver 142 of the first linear actuator 140 is movable from a "contracted" position shown in FIGS. 1-4, 7, 8 and 9 and an "expanded" position shown in FIGS. 5 and 6 by operation of transmitter 146 which is shown as being connected by cable 148 to a controller or circuit board 147 located inside a control box 150. One type of circuit board 147 known to work is manufactured by Raven Industries of Sioux Falls, S. Dak. and sold as Part No. E1003172. A remote transmitter 146 not wired to the circuit board may be used as desired.

Figure 10:
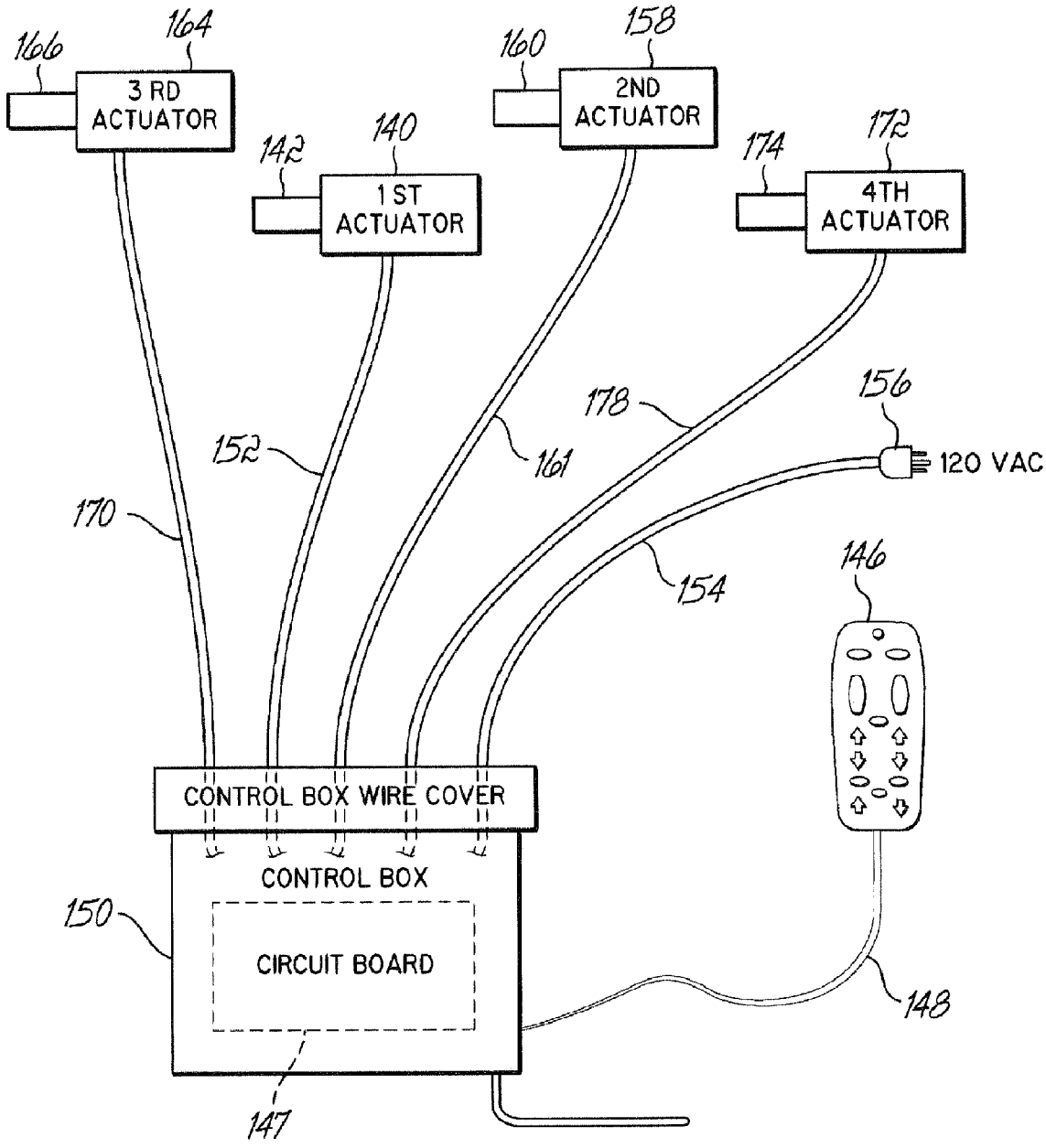
FIG. 10 is a block diagram of the control system of the adjustable bed.

Control box 150 is secured to underside of the seat deck board 38 as shown in FIG. 9. One suitable control box 150 is manufactured by Raven Industries of Sioux Falls, S. Dak. and sold as Part No. 1200. A cable 152 exiting the control box 150 is connected to the first linear actuator 140 and provides power to the first linear actuator 140. A power cord 154 having a plug 156 is also coupled to the control box 150. See FIG. 10. When the front carriage 66 is in its "in" position shown in FIGS. 1-4, 7, 8 and 9, the driver 142 of the first linear actuator 140 is in its "contracted" position. When the front carriage 66 is in its "out" position shown in FIGS. 5 and 6, the driver 142 of the first linear actuator 140 is in its "expanded" position.

As best illustrated in FIG. 2, a second motorized linear actuator 158 is secured at one end to the linear actuator support 25 of base 18. This second linear actuator 158 is used to move the rear carriage 94 between an "in" position shown in FIGS. 1-4, 7, 8 and 9 and an "out" position shown in FIGS. 5 and 6, the rollers 112 of the rear carriage 94 rotating or sliding in the channels 34 of the side rails 20 of stationary base 18. As best illustrated in FIG. 2, the second linear actuator 156 has a driver 160 which is pivotally secured to a bracket 162 secured to the intermediate member 104 of the movable rear carriage 94. The driver 160 of the second linear actuator 158 is movable from a "contracted" position shown in FIGS. 1-4, 7, 8 and 9 and an "expanded" position shown in FIGS. 5 and 6 by operation of transmitter 146. As shown in FIG. 7, a cable 161 exiting the control box 150 is connected to the second linear actuator 158 and provides power to the second linear actuator 158. When the rear carriage 94 is in its "in" position shown in FIGS. 1-4, 7, 8 and 9, the driver 160 of the second linear actuator 158 is in its "contracted" position. When the rear carriage 94 is in its "out" position shown in FIGS. 5 and 6, the driver 160 of the second linear actuator 158 is in its "expanded" position.

As best illustrated in FIG. 7, a third motorized linear actuator 164 is secured at one end to the support 82 which is part of the movable front carriage 66. This third linear actuator 164 is used to move the head deck board 92 between a horizontal position shown in FIGS. 1-3, 5 and 9 and an inclined position shown in FIGS. 4 and 6. As best illustrated in FIG. 4, the third linear actuator 164 has a driver 166 which is pivotally secured to a bracket 168. Bracket 168 is secured to the lower surface 93 of the head deck board 92 using fasteners 169. The driver 166 of the third linear actuator 164 is movable from a "contracted" position shown in FIGS. 1-3, 5 and 9 and an "expanded" position shown in FIGS. 4 and 6 by operation of transmitter 146. As shown in FIG. 7, a cable 170 exiting the control box 150 is connected to the third linear actuator 164 and provides power to the third linear actuator 164. When the head deck board 92 is in its horizontal position shown in FIGS. 1-3, 5 and 9, the driver 166 of the third linear actuator 164 is in its "contracted" position. Similarly, when the head deck board 92 is in its fully inclined position shown in FIGS. 4 and 6, the driver 166 of the third linear actuator 164 is in its "expanded" position. Regardless of whether the front carriage 66 is in its "in" position or its "out" position or somewhere between these extreme positions, the third linear actuator 164 may be independently activated by use of the transmitter 146 to incline the head deck board 92 to a desired position.

As best illustrated in FIG. 7, a fourth motorized linear actuator 172 is secured at one end to the support 110 which is part of the movable rear carriage 94. This fourth linear actuator 172 is used to move the leg and foot deck boards 120, 124 between a horizontal position shown in FIGS. 1-3, 5 and 9 and an inclined position shown in FIGS. 4 and 6. As best illustrated in FIG. 4, the fourth linear actuator 172 has a driver 174 which is pivotally secured to a bracket 176. Bracket 176 is secured to the lower surface 126 of the leg deck board 120 using fasteners 177. The driver 174 of the fourth linear actuator 172 is movable from a "contracted" position shown in FIGS. 1-3, 5 and 9 and an "expanded" position shown in FIGS. 4 and 6 by operation of transmitter 146. As shown in FIG. 7, a cable 178 "expanded" position. Regardless of whether the rear carriage 94 is in its "in" position or its "out"

position or somewhere between these extreme positions, the fourth linear actuator 172 may be independently activated by use of the transmitter 146 to incline the leg and foot deck boards 120, 124 to a desired position. As shown in FIGS. 4 and 6, when the driver 174 of the fourth linear actuator 172 is in its "expanded" position and the leg deck board 120 fully inclined, the foot deck board 124 is also fully inclined.

Although any motorized linear actuators may be used with this bed, one which has proven satisfactory is manufactured by Hubbell Special Products of Pleasant Prairie, Wis. and sold as Model MC4210074.

Although we have described one embodiment of the adjustable bed, we do not intend to be limited except by the scope of the following claims.

We claim:

1. an adjustable bed comprising:

a stationary base having a pair of opposed side rails, each of said side rails including a channel;

a pair of mounting members secured to said stationary base;

front and rear carriages movable relative to said stationary base;

rollers rotatably mounted to each of said front and rear carriages and being rotatable in said channels of said side rails of said base;

a deck including a seat deck board secured to said mounting members, a head deck board hingedly secured to said front carriage, leg and foot deck boards hingedly secured together and secured to said rear carriage;

a pair of foot links, each of said foot links being pivotally secured to one of said mounting members at one end and being pivotally secured to brackets secured to said foot deck board at the other end;

a first linear actuator secured to said base for independently moving said front carriage;

a second linear actuator secured to said base for independently moving said rear carriage;

a third linear actuator secured to said front carriage for moving said head deck board between fully inclined and horizontal positions; and a fourth linear actuator secured to said rear carriage for moving said leg and foot deck boards between fully inclined and horizontal positions.

2. The adjustable bed of claim 1 wherein said mounting members are stationary relative to the base.

3. The adjustable bed of claim 2 wherein said leg deck board is hingedly secured to said rear carriage.

4. The adjustable bed of claim 1 wherein each of said carriages has legs to which said rollers are secured.

5. The adjustable bed of claim 1 wherein each of said linear actuators may be independently activated.

6. The adjustable bed of claim 1 further comprising cushions attached to each of said deck boards.

7. The adjustable bed of claim 1 further comprising a control box mounted to said seat deck board.

8. The adjustable bed of claim 1 wherein said linear actuators for moving said front and rear carriages are mounted on a support extending between the side rails of the base.

9. The adjustable bed of claim 1 wherein said first and second linear actuators have drivers secured to the front and rear carriages.

10. An adjustable bed comprising:

a stationary base having a pair of opposed side rails and a support extending between said opposed side rails, each of said side rails including a channel;

a pair of mounting members secured to said stationary base;

front and rear carriages movable relative to said stationary base;

rollers being rotatably mounted to each of said front and rear carriages and being rotatable in said channels of said side rails of said base;

a seat deck board secured to said mounting members and extending between said mounting members;

a head deck board hingedly secured to said front carriage;

a leg deck board hingedly secured to said rear carriage;

a foot deck board hingedly secured to said leg deck board;

a first linear actuator secured to said support for moving said front carriage;

a second linear actuator secured to said support for moving said rear carriage;

a third linear actuator secured to said front carriage and including a driver secured to a bracket secured to said head deck board for moving said head deck board between fully inclined and horizontal positions; and a fourth linear actuator secured to said rear carriage and including a driver secured to a bracket secured to said leg deck board for moving said leg and foot deck boards between fully inclined and horizontal positions.

11. The adjustable bed of claim 10 further comprising a pair of foot links, each of said foot links being pivotally secured to said rear carriage at one end and being pivotally secured to a bracket secured to said foot deck board at the other end.

12. The adjustable bed of claim 10 wherein said first linear actuator includes a driver secured to said front carriage.

13. The adjustable bed of claim 10 wherein said second linear actuator includes a driver secured to said rear carriage.

14. The adjustable bed of claim 10 wherein each of said carriages has legs to which said rollers are secured.

15. The adjustable bed of claim 10 wherein each of said linear actuators may be independently activated.

16. The adjustable bed of claim 10 further comprising cushions attached to each of said deck boards.

17. The adjustable bed of claim 10 further comprising a control box mounted to said seat deck board.

18. An adjustable bed comprising:

a stationary base having a pair of opposed side rails and a support extending between said opposed side rails, each of said side rails including a channel;

mounting members fixedly secured to said stationary base;

front and rear carriages movable relative to said stationary base, each of said carriages including legs;

rollers being rotatably mounted to said legs of said front and rear carriages and being rotatable in said channels of said side rails of said base;

a stationary seat deck board secured to said mounting members and extending between said mounting members;

a head deck board hingedly secured to said front carriage and movable with said front carriage;

a leg deck board hingedly secured to said rear carriage and movable with said rear carriage;

a foot deck board hingedly secured to said leg deck board and movable with said rear carriage;

a first linear actuator secured to said support and having a driver for moving said front carriage;

a second linear actuator secured to said support and having a driver for moving said rear carriage;

a third linear actuator secured to said front carriage and including a driver secured to a bracket secured to said head deck board for moving said head deck board between fully inclined and horizontal positions; and a fourth linear actuator secured to said rear carriage and including a driver secured to a bracket secured to said leg deck board for moving said leg and foot deck boards between fully inclined and horizontal positions.

19. The adjustable bed of claim 18 wherein each of said linear actuators may be independently activated.

20. The adjustable bed of claim 18 further comprising cushions attached to each of said deck boards.

* * * * *

UNITED STATES PATENT AND TRADEMARK OFFICE

CERTIFICATE OF CORRECTION

PATENT NO. : 7,698,761 B2
APPLICATION NO. : 12/025205
DATED : April 20, 2010
INVENTOR(S) : Jacob J. Neuenswander and William R. Rohr It is certified that error appears in the above-identified patent and that said Letters Patent is hereby corrected as shown below:

Column 1

Line 57, "toot end rail" should be --foot end rail--.

Column 2

Line 16, "Each of legs" should be --Each of the legs--.
Line 54, "Alternative, with the" should be --Alternatively, when the--.

Column 4

Line 40, after the word "positions", insert a --.--.
Line 58, "and maintained" should be --and may be maintained--.

Column 5

Line 9, "Although a one type" should be --Although one type--.

Column 6

Line 17, "are illustrated" should be --is illustrated--.

Column 6

Line 46, "are illustrated" should be --is illustrated--.

Signed and Sealed this

Tenth Day of August, 2010

David J. Kappos

David J. Kappos
*Director of the United States Patent and Trademark Office*

Column 7

Line 21, after the word “although”, delete the “,”.

Column 8

Line 66, after the word “position”, add the following: --exiting the control box 150 is connected to the fourth linear actuator 172 and provides power to the fourth linear actuator 172. When the leg deck board 120 is in its horizontal position shown in Figs. 1-3, 5 and 9, the driver 174 of the fourth linear actuator 172 is in its “contracted” position. Similarly, when the leg deck board 120 is in its fully inclined position shown in Figs. 4 and 6, the driver 174 of the fourth linear actuator 172 is in its “expanded” position.--.

Column 9

Line 6, “120 fully” should be --120 is fully--.